United States Patent [19]

Santoiemmo et al.

[11] Patent Number: 4,735,348

[45] Date of Patent: Apr. 5, 1988

[54] APPARATUS FOR MAKING A CARBONATED BEVERAGE

[75] Inventors: Carl V. Santoiemmo, Gates Mills; Robert M. Beardslee, Willowick, both of Ohio

[73] Assignee: Norcarl Products, Inc., Gates Mills, Ohio

[21] Appl. No.: 819,401

[22] Filed: Jan. 16, 1986

Related U.S. Application Data

[63] Continuation-in-part of Ser. No. 491,564, May 4, 1983, abandoned, which is a continuation-in-part of Ser. No. 453,350, Dec. 27, 1982, abandoned.

[51] Int. Cl.[4] ..... B65D 83/00

[52] U.S. Cl. ..... 222/399; 222/400.7; 222/469

[58] Field of Search ..... 222/394, 399, 400.7, 222/402.15, 396, 469, 473, 474, 465 R, 130, 131, 173, 183; 261/DIG. 7

[56] References Cited

U.S. PATENT DOCUMENTS

| | | | |
|---|---|---|---|
| 1,602,745 | 10/1926 | Binkele | 222/142.6 |
| 1,988,979 | 1/1935 | Campbell | 222/399 |
| 2,017,664 | 10/1935 | Leins | 222/399 |
| 2,172,035 | 9/1939 | Roth | 222/399 |
| 2,649,661 | 8/1953 | Lamb | 222/399 |
| 2,732,977 | 1/1956 | Charpiot | 222/399 |
| 2,822,054 | 2/1958 | Howard | 222/400.7 |
| 3,109,565 | 11/1963 | Kutik | 222/394 |
| 3,143,254 | 8/1964 | Vanderhyde | 222/402.1 |
| 3,420,418 | 1/1969 | Rousset et al. | 222/399 |

FOREIGN PATENT DOCUMENTS

| | | | |
|---|---|---|---|
| 151635 | 3/1932 | Fed. Rep. of Germany . | |
| 2480899 | 10/1981 | France | 222/469 |
| 280141 | 11/1927 | United Kingdom . | |
| 643020 | 9/1950 | United Kingdom . | |
| 1146399 | 3/1969 | United Kingdom . | |
| 2068521 | 2/1980 | United Kingdom . | |

*Primary Examiner*—Joseph J. Rolla
*Assistant Examiner*—Kenneth Noland
*Attorney, Agent, or Firm*—Micahel Sand Co, LPA

[57] ABSTRACT

A thermo-insulated vessel is provided with a plurality of sealed inserts containing a freezable substance adapted to cool a liquid stored in said vessel. The vessel is also provided with means to carbonate the liquid and to dispense the carbonated liquid upon demand.

21 Claims, 7 Drawing Sheets

APPARATUS FOR MAKING A CARBONATED BEVERAGE

CROSS REFERENCE

This application is a continuation-in-part application of application Ser. No. 491,564, filed May 04, 1983, entitled METHOD AND APPARATUS FOR MAKING A CARBONATED BEVERAGE and now abandoned, which was a continuation-in-part application of application Ser. No. 453,350, filed Dec. 27, 1982 and now abandoned.

BACKGROUND ART

This invention relates to improvements in domestic dispensers of carbonated beverages which are easily transportable from place to place and are also suitable for use away from home such as on trips, picnics, or vacation.

Base on figures published in Beverage, the consumption of carbonated beverages has increased from approximately 12 ounces per capita in 1849 to over 5000 ounces per capita in 1981. So-called soft drinks now enjoy approximately 40% of the beverage market compared with the next most popular beverage, coffee, which has about a thirty percent share of the market. All other juices, and bottled water, account for the remaining thirty percent of the market.

As a consequence, there is a trend to package soft drinks in ever increasingly larger containers. At the present time, two-liter plastic bottles are very popular. However, if the contents are not consumed over a relatively short period of time, the carbonation fairly quickly dissipates, resulting in a flat, unappetizing tasting beverage. Further, handling, transportation, storing and disposal of two-liter bottles is awkward and burdensome. The only present variable alternative for a quality beverage is a smaller container, such as 10-ounce and 12-ounce six packs. However, these sizes of containers are relatively more expensive and otherwise present the same problems as the two-liter bottles.

It is therefore an important object of the present invention to overcome the foregoing and other disadvantages of presently available soft drink containers by providing a do-it-yourself soft drink making device in which soft drinks of any flavor may be mixed, carbonated, chilled, stored, and dispensed at will over a long period of time without loss of flavor or carbonization.

It is another object of the present invention to provide a soft drink making device in which carbonated beverages can be made in the home at a fraction of the cost of similar commercially packed soft drinks.

Yet another object of the present invention is to provide premeasured containers of flavoring syrups the contents of which can be mixed with a predetermined measure of water in the invention vessel to consistently provide soft drinks of uniformly high quality.

Another object of the invention is to provide a soft drink making device which the average person can learn to use by following a few easily understood instructions.

Another object of the invention is to provide a soft drink making device so inexpensive that with average use, the purchase price of the device can be recovered in a short period of time.

Another important object of the invention is to provide a two-piece soft drink making device comprising a charging and dispensing top and a mixing, cooling, and storage vessel which can be easily assembled and disassembled for mixing or cleaning purposes.

Another object of the invention is to provide an easily accessible carbon dioxide pressure capsule compartment in the top of the device, the closing of which automatically charges the vessel with carbon dioxide gas.

A further important object of the invention is the provision of simple, easily maintained charging, mixing, and dispensing mechanisms interconnected by internal passageways to conduct the flow of liquid therethrough under the control of simple valve means.

A still further important object of the invention is to provide an inexpensive, efficiently designed device which, from a construction, assembly, operational and aesthetic perspective, is ideally suited for domestic use.

An additional object of the present invention is to provide a device having hand-operable dispensing controls which are convenient to user operation.

Another object of the invention is to provide such a device having a dispensing valve mechanism which provides a pressure relief function to discharge excess pressure from within the storage vessel preventing possible damage to the vessel or user thereof.

These and other objects and advantages will become apparent to those skilled in the art upon reading the following specification, drawings and claims.

BEST MODE FOR CARRYING OUT THE INVENTION

Figure 1:
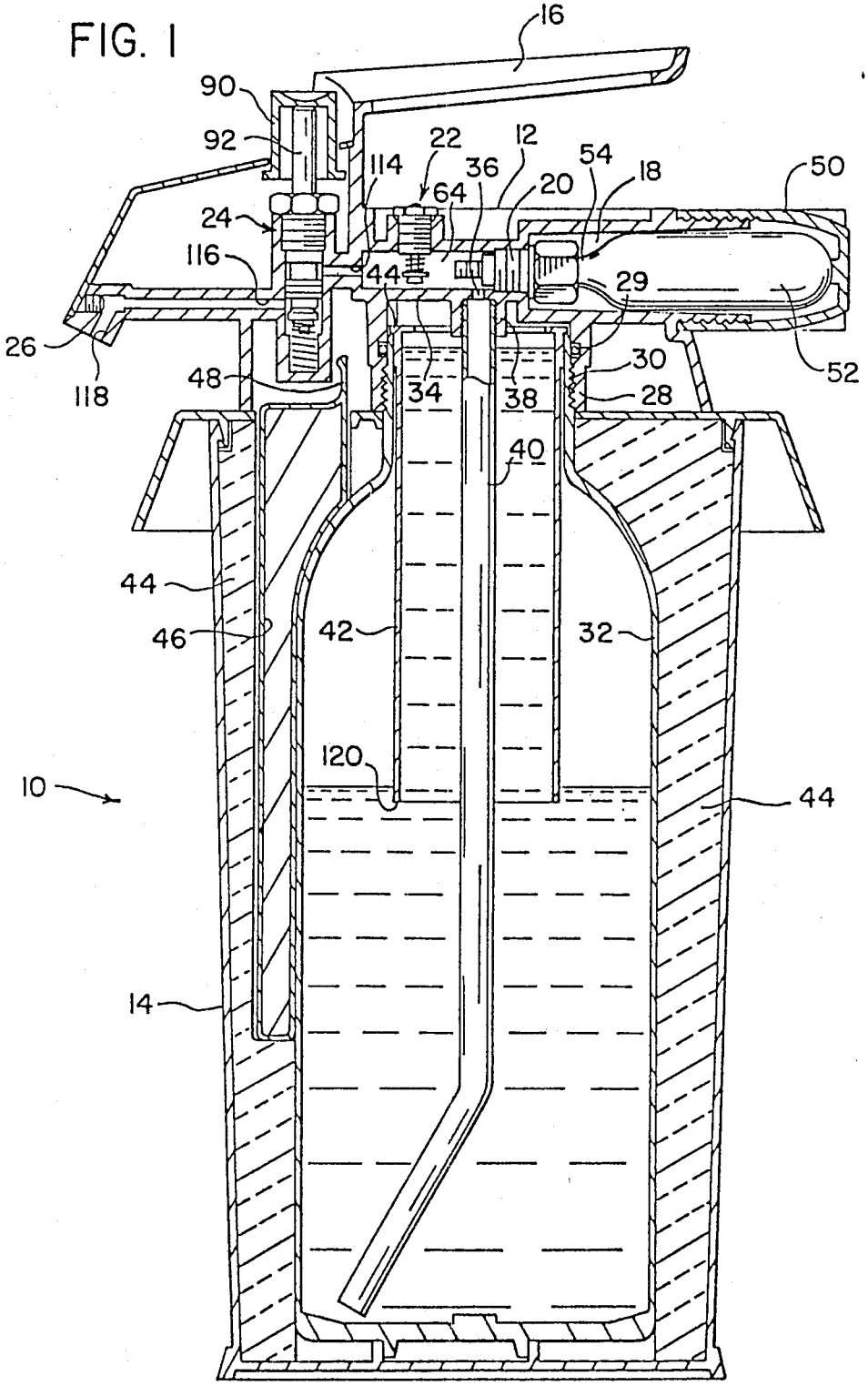
FIG. 1 is an elevational view in section of a preferred embodiment of the invention.

Referring to the drawings in greater detail, and in particular to FIG. 1, there is shown in elevational full section a preferred embodiment of the assembled invention 10 comprising a top 12 and a mixing and storage container 14. The top includes a carrying handle 16, a carbon dioxide capsule chamber 18, a charging check valve assembly 20, a pressure indicator 22, a dispensing valve 24, and a dispensing nozzle 26. An internally threaded collar 28 extends downwardly from the underside of the top 12 to threadedly connect with externally threaded neck portion 30 projectin upwardly from an internal vessel 32. An O-ring 29 provides a pressure tight seal between collar 28 and neck 30. Collar 28 has a horizontal cap 34 containing a port 36 about which a depending collar 38 is concentrically positioned to receive the upper end of a carbon dioxide charging and dispensing tube 40. A hollow cylinder 42 is sized to fit snugly within the neck 30 of vessel 32. A bead 44 at the upper end of cylinder 42 is provided to rest on the upper rim of the neck 30 to position the cylinder 42 concentrically vertically within the vessel 32. The vessel 32 is bottle-shaped to provide a concentric air space between the vessel 32 and the cylinder 42. The walls and bottoms of the container 14 and the vessel 32 are also concentrically spaced apart to provide space for insulation 44. At the upper portion of the container additional space is provided between the insulation 44 and the vessel 32 for a plurlity of vessel chilling cartridges 46. The cartridges have tabs 48 for ease of insertion and removal.

Carbon dioxide capsule chamber 18 is threaded on its open end to receive threaded cap 50 thereon. By inserting a capsule 52 in chamber 18 and threading cap 50 onto the open end of chamber 18, a necked end 54 of capsule 52 is sealed by O-ring 56 (FIG. 2) and pierced by needle 58. O-ring 56 is carried in an internal groove 60 machined in a threaded adapter 62. Adapter 62 is threaded into a charging valve chamber 64. The right end of adapter 62 is counterbored to form a chamber 63 for receiving the neck 54 of capsule 52 in sealing contact with O-ring 56. The left side of adapter 62 is counterbored and threaded to form a chamber or bore 65 for receiving a threaded sleeve 66 containing a spring 68 and ball 70. The ball is urged by spring 68 against a ball seat 72 formed in a base block 74 of needle 58. A partition 76 divides chambers 63 and 65, which are joined by a hole 78 to permit needle 58 to enter chamber 63. Blow-by between chambers 63 and 65 is prevented by O-ring 80 positioned concentrically over needle 68 and between base block 74 and partition 76. When the neck 54 of a carbon dioxide cartridge is pierced by needle 58, the pressure of the gas released from capsule 52 forces ball 70 away from its seat 72 by compressing spring 68, carbon dioxide gas is thus permitted to pass through port 36 into charging and dispensing tube 40 and thence into the lower end of vessel 32.

Figure 3:
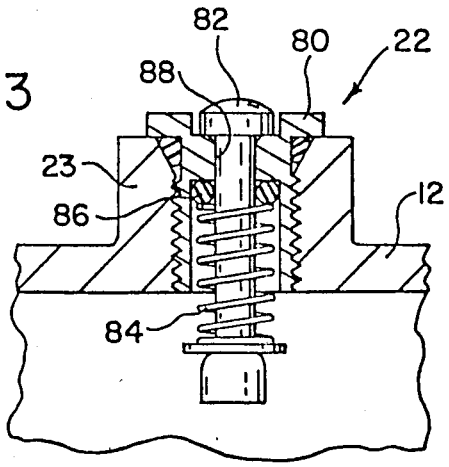
FIG. 3 is an enlarged, fragmentary, detailed view of the pressure indicator shown in FIG. 1.

Reference is now made to FIG. 3, wherein is shown the pressure indicator 22. This device comprises an adapter sleeve 80 threadably secured into a boss 23 of cap 12 to contain a plunger 82 urged downwardly by spring 84. An O-ring 86 provides a seal between plunger 82 and the internal wall 88 of sleeve 80. When the neck 54 of the carbon dioxide capsule 52 is pierced, the escaping gas forces the plunger 82 upwardly, indicating to the user that the cartridge was properly charged and that it was properly pierced to release its charged carbon dioxide into the vessel 32.

Figure 4:
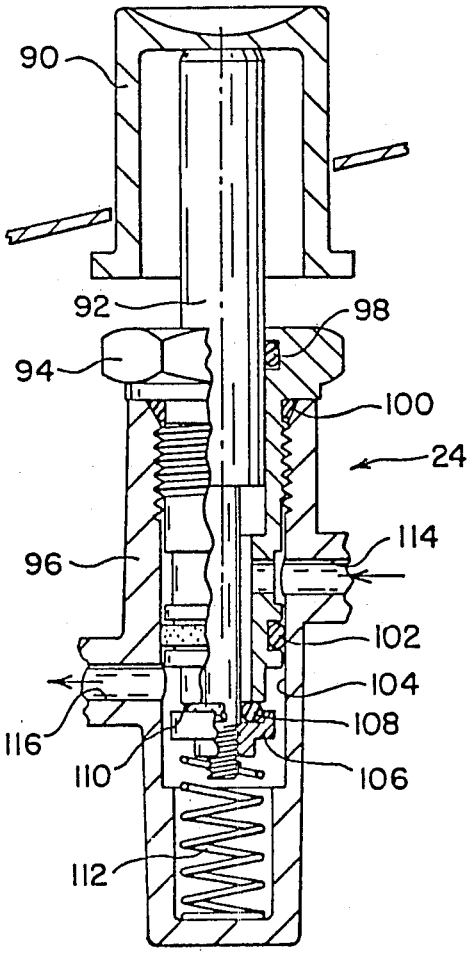
FIG. 4 is an enlarged, fragmentary, detailed view, partially in section, of the dispensing valve shown in FIG. 1.

Reference is now made to FIG. 4, showing the dispensing valve mechanism 24. After the liquid in the vessel 32 has been charged, it may be selectively dispensed in measured amounts by pushing down on plunger cap 90 which depresses plunger 92. Plunger 92 is housed in a threaded adapter sleeve 94 threadedly secured in upstanding threaded boss 96 of cap 12. An O-ring 98 provides a pressure seal between plunger 92 and adapter sleeve 94. An O-ring 100 seals between the upper portions of adapter sleeve 94 and boss 96. An O-ring 102 seals the lower portions of adapter sleeve 94 and a well wall 104 integrally formed in cap 12. A sealing flange 106 is threadedly secured to the lower end of plunger 92 to contain o-ring 108 which makes sealing contact between the lower end of plunger 92 and the lower periphery 110 of adapter sleeve 94. O-ring 108 is urged upwardly in sealing engagement with adapter sleeve periphery 110 by spring 112. When plunger 92 is depressed, O-ring 108 is lowered out of sealing engagement with periphery 110, thereby placing charging valve chamber port 114 in communication with well port 116 and orifice 118 (FIG. 1) of dispensing nozzle 26.

Referring to FIGS. 5–8, a second embodiment of the present invention is illustrated. For purposes of convenience, structural aspects of this embodiment which substantially correspond with those described above in respect to the first embodiment are not discussed in detail hereafter.

Figure 5:
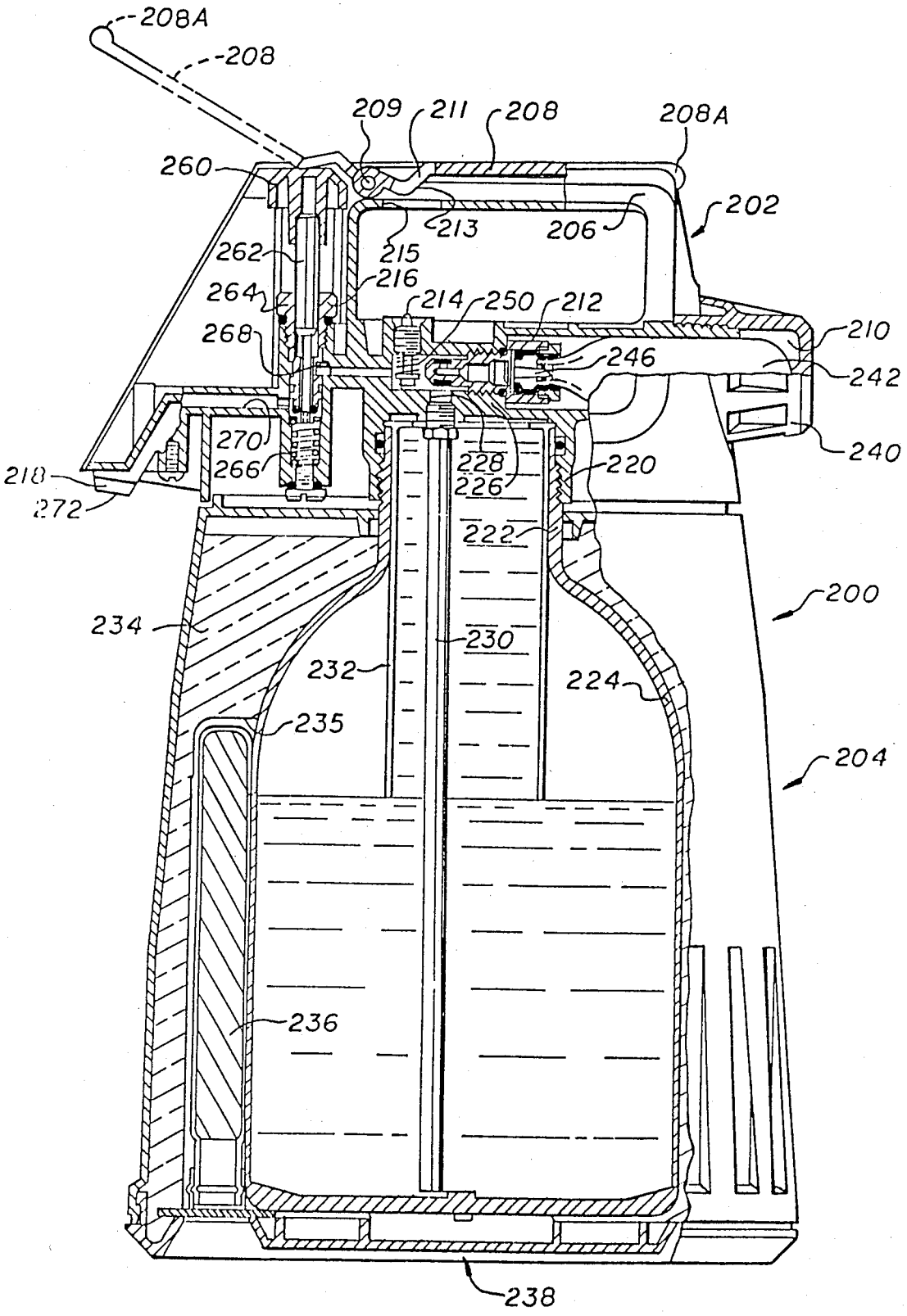
FIG. 5 is an elevational view similar to FIG. 1, showing a second embodiment of the invention.
Figure 6:
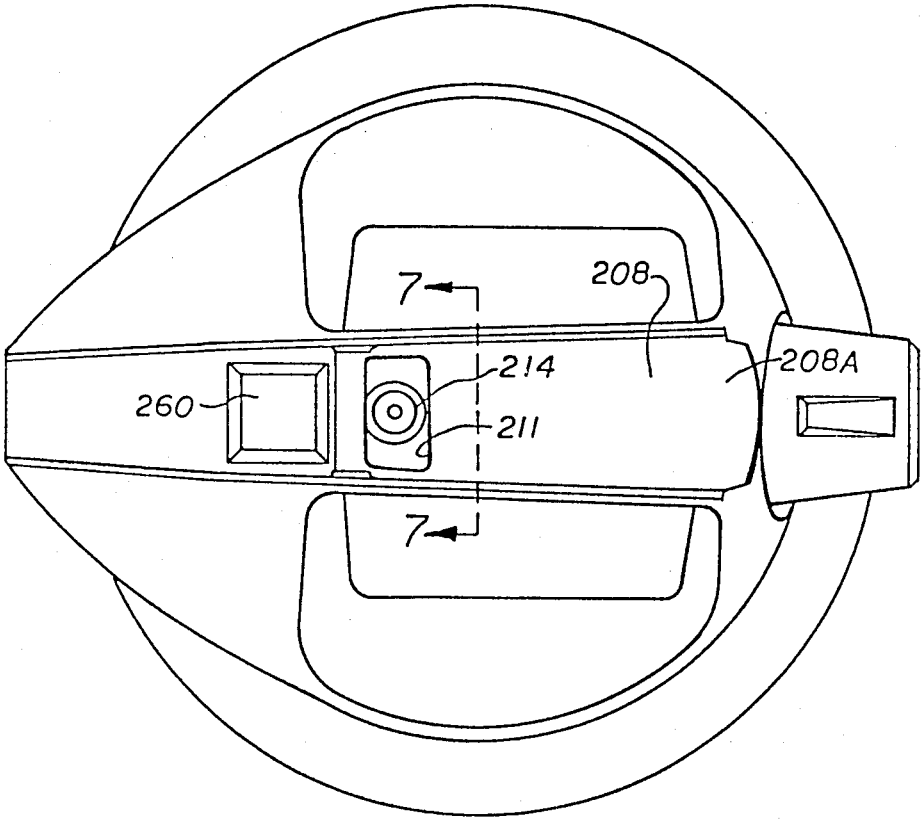
FIG. 6 is a top plan view of the embodiment shown in FIG. 5.

With particular reference to FIGS. 5 and 6, there is shown a soft drink making device 200, including a top 202 and a mixing and storage container 204. The top includes a carrying handle 206 having a selector member 208 pivotally mounted thereto.

Figure 7:
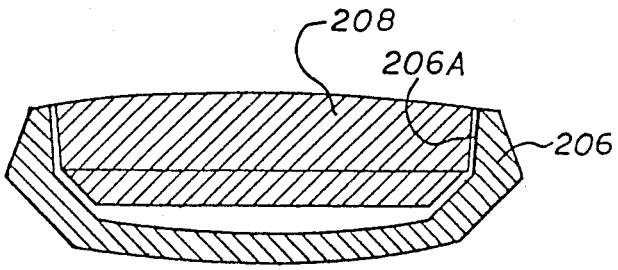
FIG. 7 is a sectional view taken on line 7—7, FIG. 6.

Referring to FIGS. 6 and 7, the carrying handle 206 is an integrally formed part of the top 202 and the selector member 208 is pivotally mounted to the handle by a pin 209. The selector member 208 is shown in solidline in its storage position within an upwardly opening recess **206*a* in the handle 206**, and the selector is shown in phantom ouline in its operating position projecting upwardly from the handle.

The selector member 208 includes a bulbous enlargement at the distal end **208*a* thereof remote from the pin 209. In the storage position, the selector member supplements the cross-sectional configuration and apparent bulk of the handle 206 to provide a comfortably sturdy-feeling grip for the user. Further, the selector member is dimensioned to extend slightly rearwardly from the groove 206*a* in the handle 206. The selector member also includes an aperture or opening 211 and a clearance bend 213**.

The remaining major elements of the top 202 include a carbon dioxide capsule chamber 210, a charging check valve assembly 212, a pressure indicator 214, a dispensing valve 216, and a dispensing nozzle 218.

An internally threaded collar 220 extends downwardly from the top 202 for threaded connection with an externally threaded neck portion 222 projectin upwardly from an internal vessel 224. The collar 220 includes a horizontal cap or end wall 226 containing a port 228 which communicates with the upper end of a carbon dioxide charging and dispensing tube 230. A hollow cylinder 232 extends downwardly into the neck 222 of the vessel 224.

The vessel 224 is shaped to provide a concentric air space between the vessel and the hollow cylinder 232. Insulation 234 is provided intermediate the adjacent walls of the vessel 224 and the container 204. Adjacent the lower portion of the container 204, plurality of pockets or compartments 235 (only one being shown) are provided between the insulation 234 and the vessel 224 for receiving vessel chilling cartridges 236.

Figure 9:
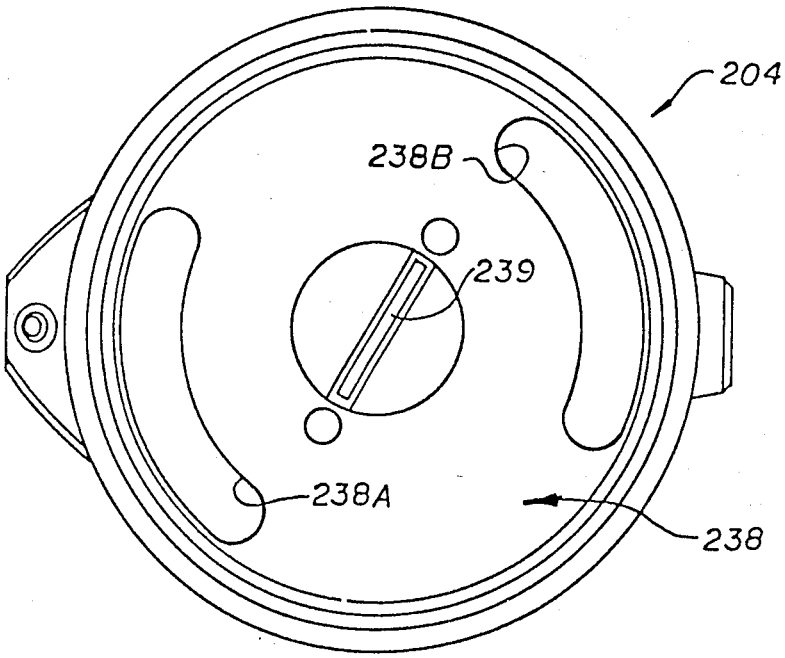
FIG. 9 is a bottom plan view on a reduced scale of the embodiment of FIG. 5.

Referring to FIGS. 5 and 9, a rotatable closure 238 is provided at the bottom of the mixing and storage container 204 for allowing insertion of cartridges 236 into the compartments 235. The closure 238 includes a central rib handle 239 and a pair of openings **238*a* and 238*b***.

The closure 238 is rotatable to a cartridge loading and unloading position with the openings 238*a* and 238*b* being in registry with the open ends of the compartments 236. As shown in FIG. 5, an upper surface of the closure 238 retains the loaded cartridges 236 in the compartments 235 when the closure 238 is moved to the illustrated close position.

Figure 8:
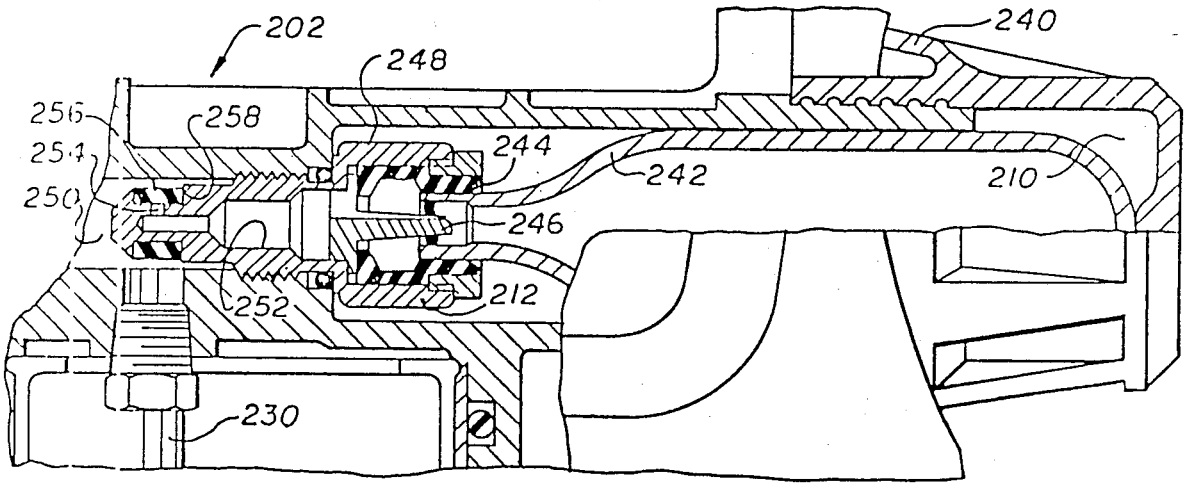
FIG. 8 is an enlarged, fragmentary, detailed view in section of the carbon dioxide capsule charging valve shown in FIG. 5.

The carbon dioxide capsule chamber 210 is closed by means of a threaded cap 240, as most clearly shown in FIGS. 5 and 8. A carbon dioxide capsule 242 is inserted into the chamber 210 and an elastomeric valve seal member 244 forms a seal with the necked end of the capsule 242 as the capsule is pierced by needle 246. The needle 246 is mounted within a threaded adapter or valve body 248 which extends into a charging valve chamber 250 formed in the top 202.

Referring to FIG. 8, the adapter 248 includes an internal bore 252 which communicates with the passage of the needle 246 and terminates at an exhaust port 254. The opening of the exhaust port 254 into the chamber 250 is opened and closed by an elastomeric valve member 256. The member 256 has an annular configuration, and it is received within a groove 258 in the adapter 248. The member 256 is normally tensioned across the opening of the exhaust port 254 to close the port. As discussed below in greater detail, the carbon dioxide pressure within a connected capsule will extend the member 256 to allow the carbon dioxide charge of the capsule to pass into the chamber 250.

The pressure indicator 214 is identical in structure and operation with the indicator 22 described above. The indicator 214 is visible through the aperture 211 and aligned opening 215 in the handle 206 when viewed from the top of the device as shown in FIG. 6.

The dispensing valve 216 is similar in structure and operation with the dispensing valve 24 described above. However, the structure and operation of the valve 216 are briefly described hereinafter for purposes of further clarifying the subsequent description of the operation of the selector member 208.

The dispensing valve 216 is operated by depressing an external plunger cap or button 260, which in turn displaces the plunger 262. The plunger 262 is mounted within a threaded sleeve adapter 264, and its displacement is resisted by a spring 266 which serves to normally bias the valve 216 to a closed position. Upon depression of the plunger button 260 and plunger 262, a charging valve chamber port 268, which communicates with chamber 250, is placed in communication with a well port 270 and orifice 272 of the dispensing nozzle 218.

OPERATION OF THE MECHANISM

Figure 2:
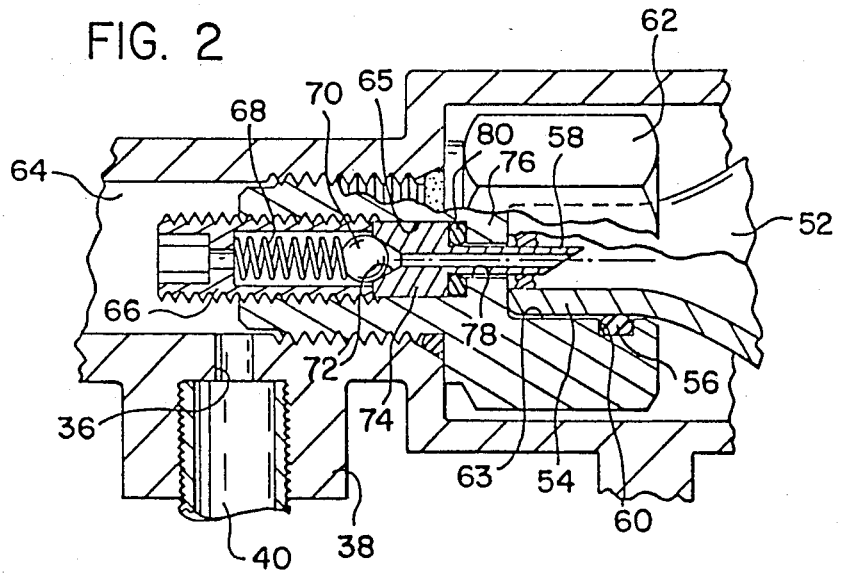
FIG. 2 is an enlarged, fragmentary, detailed view in section of the carbon dioxide capsule charging valve shown in FIG. 1.

Reference is made to FIG. 1. The container cap 12 is unscrewed from container neck 30. With the filler cylinder 42 in position, a pre-measured amount of syrup is poured down the cylinder. Pre-chilled water is then poured down the cylinder, and as the water fills in the lower end of the vessel 32, air is compressed between the inner wall of the vessel 32 and the outer wall of the cylinder 42. When the level of the water reaches the lower edge 120 of cylinder 42, the air is trapped between the vessel 32 and cylinder 42. The user continues to add water until the cylinder 42 is filled, further compressing the air between vessel 32 and cylinder 42. Prefozen cartridges 46 are then inserted in the spaces provided between the container insulation 44 and the outer wall of vessel 32. Cap 12 is then replaced on the vessel neck 30. A carbon dioxide capsule 52 is inserted in chamber 18 and cap 50 is screwed on to urge the capsule into piercing contact with needle 58 (FIG. 2). Carbon dioxide gas passes down tube 40 to carbonate the mix of syrup and chilled water in vessel 32. The vessel is now charged. This is indicated by the pressure indicator 22, which has been forced into its up position by the pressure of the carbon dioxide charge. The carbonated beverage is now ready for consumption. Plunger cap 90 (FIG. 1) is depressed to open nozzle orifice 118 to the interior of vessel 32. The pressure in vessel 32 forces the beverage up tube 40, through chamber 64, port 114, around plunger valve 92, through port 116, and finally through orifice 118 of nozzle 26 into a drinking cup. Once a desired amount of beverage has been dispensed, plunger cap 90 is released, the system re-seals, and the carbonation of the beverage is maintained.

The embodiment of FIGS. 5–8 operates in substantially the same manner as described above with respect to the first embodiment. Thus, the common features of the filling and dispensing operations with respect to the second embodiment are not described herein. However, the further advantages in the filing and dispensing operations in accordance with the second embodiment are discussed below.

The cartridges 236 are bottom loaded into the device by simply rotating the closure 238 to place the openings 238*a* and 238*b* into registry with the compartments 235. After the cartridges have been inserted into the compartments, the closure is rotated out of registry and the cartridges are retained in the compartments by the adjacent upper surface of the closure 238.

As indicated above, the charging valve assembly 212 of the second embodiment includes an elastomeric valve member 256 which provides the check valve function. More particularly, the insertion of the capsule 242 and puncture thereof with needle 246 results in the filling and pressurization with carbon dioxide of the bore 252 and exhaust port 254. The pressure of the carbon dioxide is sufficient to displace the elastomeric member 256 from its sealing position across the opening of the port 254. Accordingly, the charge of carbon dioxide enters the charging valve chamber 250 and passes downwardly through the tube 230 for purposes of carbonating and pressurizing the liquid charge within the vessel 224. The member 256 is arranged to return to its normally sealed position across the opening of the port 254 due to its resiliency once the carbon dioxide charge of the capsule 242 has been received within the device 200.

For purposes of dispensing soft drink from the device 200, the plunger cap or button 260 may be depressed, as in the device of the first embodiment. Alternatively, it may be more convenient to move the selector member 208 to its operating position engaging the plunger cap 260, as shown in phantom outline in FIG. 5. For example, a user may simply grasp the distal end 208*a* and pivot the selector 208 about the pin 209. As shown in FIG. 5, the adjacent edge of the plunger cap 260 is received within the opening 211 and the clearance bend 213 in order to reduce the lateral loading of the cap 260 and the plunger 262 as the selector member 208 is pivoted about the pin 209 and used as a lever to operate the plunger cap 260.

In its operating position, the selector 208 projects from the carrying handle 206 in an angular orientation adjacent to and above the dispensing nozzle 218. Thus, the selector and dispensing nozzle are both adjacent to a user standing in front of the device, i.e., to the left of the device as shown in FIG. 5. This is particularly advantageous when the device is positioned on a countertop and/or below cabinets so as to make it inconvenient to directly operate the plunger cap 260 and manipulate the glass or vessel to be filled with soft drink.

Figure 10:
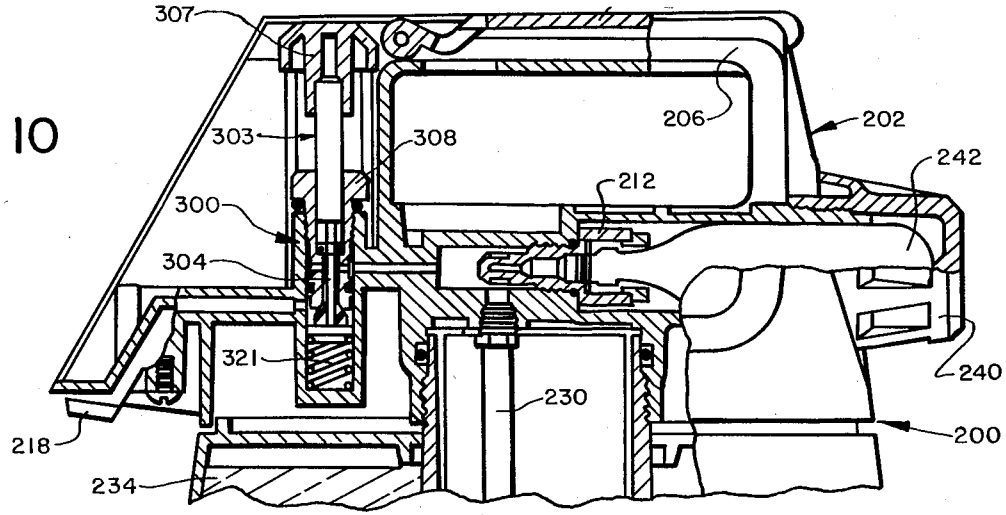
FIG. 10 is a fragmentary, elevational view with portions broken away and in section, similar to the top portion of FIG. 5 showing an improved pressure relief and dispensing valve incorporated therein.
Figure 11:
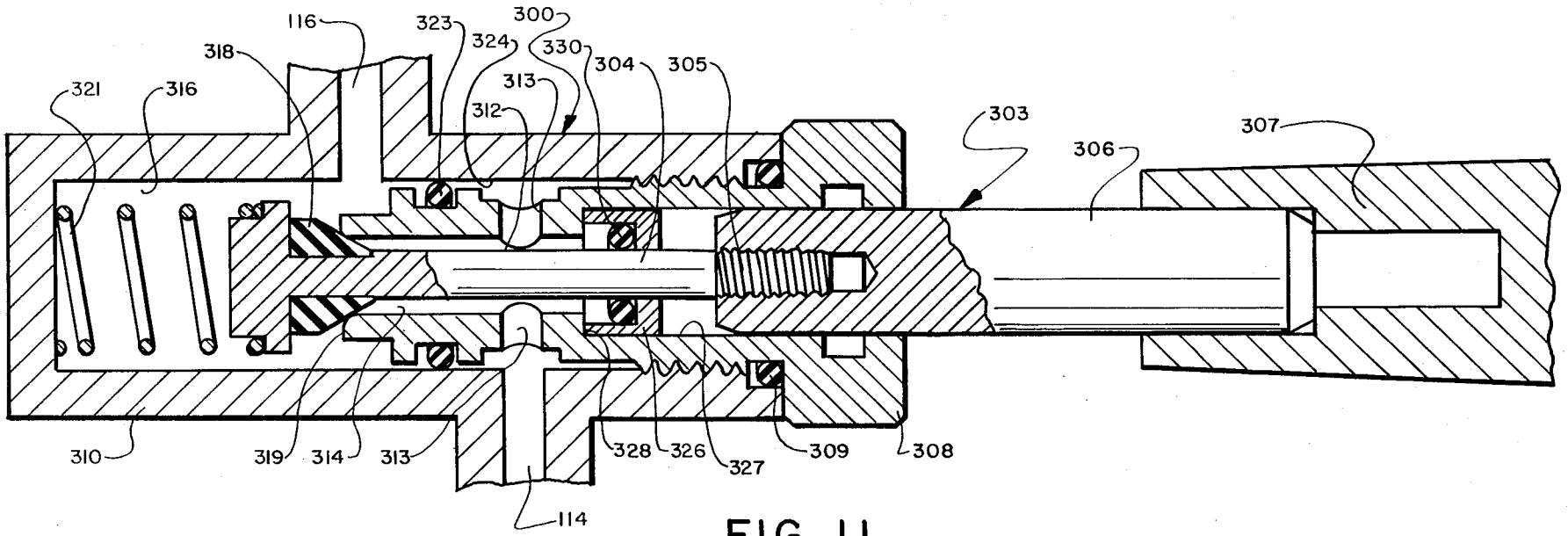
FIG. 11 is an enlarged, fragmentary detailed view, partially in section, of the pressure relief and dispensing valve of FIG. 10.

A further modification to the invention is shown in FIGS. 10 and 11 in which a pressure relief and dispensing valve assembly, indicated generally at 300, is mounted in the top 202 of device 200 of FIGS. 5 and 6. This modified device is similar in all respects to device 200 except for the removal of pressure indicator 214 and the replacement of dispensing valve 216 thereof with valve assembly 300. Valve 216 of device 200 is similar in many respects to valve 24 (FIG. 4) of the dispenser shown particular in FIG. 1.

It is desirable that a pressure relief means be provided for the invention to prevent the build up of possibly harmful pressure within the vessel caused by improper usage thereof by a user. Instead of adding a separate pressure relief valve, assembly 300 incorporates the pressure relief feature and dispensing feature in the same unit.

Referring to FIG. 11, improved valve assembly 300 includes a plunger indicated generally at 303, having a reduced diameter section 304 having a threaded end 305 attaching it to upper plunger section 306 on which is mounted a plunger cap 307. Plunger 303 extends through an adapter sleeve 308 which is sealed by O-ring 309 with the upper portion of an annular boss 310. Charging valve chamber port 114 communicates with an annular groove 312 formed in an intermediate portion of adapter sleeve 308 and is connected by a pair of diametrically opposite ports 313 to an annular chamber 314 which surrounds plunger section 304 within the interior of adapter sleeve 308. Well port 116 communicates with a well 316 and with annular chamber 314 when plunger 303 is in an open dispense position. A frusto-conical shaped sealing ring 318 is urged upwardly into sealing engagement with adapter sleeve periphery 319 by sealing flange 320 which is located on the end of plunger section 304. Sealing flange 318 is biased into sealing engagement with adapter sleeve periphery 319 by a compression coil spring 321 similar to springs 112 and 266 described above.

Another O-ring 323 provides a seal between the outer surface of adapter sleeve 308 and well wall 324. A sealing cap 326 is secured by a press fit or other means within the interior of an enlarged diameter upper bore 327 of adapter sleeve 308 and is located on an annular shoulder 328 formed between bore 327 and annular chamber 314. Plunger section 304 slidably extends through a hole 329 formed in the top of sealing cap 326 with an O-ring 330 providing a seal between sealing cap 326 and plunger section 304.

The manual operation of valve assembly 300 is similar to that described above with respect to device 200 whereupon depression of plunger 303 will move sealing ring 318 out of sealing engagement with the lower periphery 319 of the adapter sleeve permitting the passage of carbonated beverage from port 114 through annular chamber 314 and out of port 116 for discharge through the dispensing nozzle 218. However, in accordance with one of the features of improved valve assembly 303, it will rapidly discharge such pressure should the pressure within the vessel reach a predetermined pressure. The level of the pressure at which valve assembly 303 is automatically actuated and is dependent primarily upon the biasing force of spring 321. Excess pressure within the vessel will usually result from the carbon dioxide not mixing with the liquid in the vessel and will enter chamber 314 through port 114 and be exerted against sealing ring 318 and upper sealing cap 326. Since sealing cap 326 is firmly secured within adapter sleeve 308, the pressure will overcome the biasing force of spring 321 forcing sealing ring 318 out of engagement with periphery 319 permitting the excess carbon dioxide and/or carbonated beverage to pass from port 114 through chamber 314 and out of port 116 and then through dispensing nozzle 218. This permits the pressure to drop quickly to prevent damage to the invention and possible harm to a user thereof. However, such a condition will not occur unless the unit is operated incorrectly by the user. Upon the pressure within the vessel dropping to the desired limit, spring 321 will move sealing ring 318 against the lower periphery of the adapter sleeve, again blocking the passage of the carbonated beverage.

The preferred beverage capacity of the vessel is about two liters, which is comparable to the two-liter plastic soft drink bottles now available in beverage stores. However, a special six-pack of pre-measured syrup, or packets of powdered flavoring material, to be made available and distributed by the inventor, sufficient to make twelve liters of beverage, is not more difficult to transport than a single two-liter bottle of commercially bottled beverage. Simultaneously, storage and disposal requirements are reduced to one-sixth of the space required for a comparable number of two-liter bottles. At present costs, soft drinks can be prepared in the subject invention for approximately one cent per ounce, compared to about three or four cents per ounce for commercially bottled soft drinks.

The foregoing description of the preferred embodiment of the invention has been made for illustration purposes, since modifications will occur to those skilled in the art which may be made without departing from the scope of the appended claims.

What is claimed is:

1. A liquid carbonating and dispensing device comprising a container: a vessel within said container; insulation between said container and said vessel; at least one pocket between said insulation and said vessel to insert cartridge means filled with a freezeable substance; an opening at the upper end of said vessel; a hollow cylinder freely fitted within said opening to project concentrically downwardly within said vessel to form an air pocket between the outer surface of said cylinder and the inner surface of said vessel; a cap removably securable to the upper end of said vessel; a carbon dioxide capsule chamber formed in said cap; a check valve chamber formed in said cap adjacent said capsule chamber; a partition between said chambers having an opening therethrough; needle and check valve means in said check valve chamber with said needle projecting through said partition opening and into said capsule chamber; means to urge said capsule against said needle to pierce said capsule; a first port in said check valve chamber; a combination charging and dispensing tube secured at one end to said first port and extending into said vessel with its opposite end adjacent the lower end of said vessel; a dispensing valve chamber formed in said cap; a dispensing valve in said dispensing valve chamber; a second port in said check valve chamber connecting said check valve chamber and said first port with said dispensing valve chamber; a port in said dispensing valve chamber selectively connectable by said dispensing valve to said check valve chamber second port; and a dispensing nozzle in communication with said dispensing valve chamber port; whereby, with said dispensing valve blocking communication between said check valve chamber second port and said dispensing valve chamber port, when said carbon dioxide capsule is pierced, carbon dioxide gas forces said check valve open and passes down said charging and dispensing tube into said vessel and whereby, with said dispensing valve unblocking communication between said check valve chamber second port and said dispensing valve chamber port, carbon dioxide gas returns up said charging and dispensing tube, through said first and second check valve chamber ports, said dispensing valve chamber port and out of said dispensing nozzle.

2. The device of claim 1, including an orifice in said cap communicating with said check valve chamber; a pin extending from the interior of said check valve chamber through said orifice to the exterior of said cap; pressure sealing means between said pin and said cap; said pin being shiftable through said orifice; spring means to bias said pin downwardly into said chamber; and detents on opposite sides of said pin to delimit its movement within said orifice, whereby said pin will be forced upwardly when said carbon dioxide capsule is pierced to indicate that the vessel has been pressurized.

3. The device of claim 2, including external control means for a user of the device to operate said valve means between said open and closed positions, said control means including a hand-manipulable selector member movable to an operating position for engaging said control means.

4. The device of claim 3, wherein said control means includes a button member which is also hand-manipulable by a user of the device to operate said valve means and said selector member is movable between said operating position engaging said button member and a storage position disengaged from said buttom member.

5. The device of claim 4, wherein said cap includes a carrying handle having said button member located adjacent thereto and also having a recess therein for receiving said selector member in said storage position, said selector member being pivotally mounted to said handle for movement between said operating and storage positions.

6. The device of claim 5, wherein said selector member in said storage position supplements the cross-sectional configuration and apparent bulk of said carrying handle.

7. The device of claim 5, wherein said selector member projects from said carrying handle in said operating position and has its distal end located adjacent said dispensing nozzle.

8. The device of claim 1, wherein said dispensing valve is responsive to a predetermined pressure within the vessel and automatically unblocks communication between the check valve chamber second port and the dispensing valve chamber port whereby a portion of the carbon dioxide gas passes through said second check valve chamber port and dispensing valve chamber port and out of dispensing nozzle to reduce pressure within the vessel.

9. The device of claim 8, wherein spring means biases the dispensing valve into blocking communication between the check valve second port and the dispensing valve chamber port until the pressure within the vessel is greater than the biasing force of the spring wherein said dispensing valve unblocks said communication between said check valve second port and said dispensing valve chamber port.

10. A liquid carbonating and dispensing device comprising: a vessel having an air chamber; a removable cap securable to said vessel in communication with the interior of said vessel; means to pour liquid into said vessel to compress air in said air chamber when said cap is removed; means to pass carbon dioxide through said cap into the vessel when said cap is secured to said vessel; valve means having open and closed positions in said cap and in association with a dispensing nozzle; wherein the valve means includes an adapter sleeve mounted in the cap and a plunger reciprocally slidably mounted within said adapter sleeve for opening and closing said valve means; spring means for biasing the plunger into the closed position; and means directing the carbon dioxide against the biasing force of the spring means whereby the plunger is moved to the open position upon the pressure exerted by the carbon dioxide overcoming the pressure exerted by the spring means, means to pass carbonated liquid out of said vessel and through said dispensing nozzle responsive to said valve means being in the open position; wherein the means to pass carbonated liquid out of the vessel and through the dispensing nozzle when the valve means is in the open position includes inlet and outlet ports communicating with an annular chamber formed between the plunger and adapter sleeve; said chamber having first and second ends with said first end being selectively open and closed by the plunger for permitting the carbon dioxide and carbonated liquid to pass out of the vessel and through the dispensing nozzle, and with said valve means being responsive to a predetermined pressure within the vessel to automatically move from the closed to the open position to discharge a portion of the carbon dioxide through the dispensing nozzle.

11. The device of claim 10, including external control means for a user of the device to manually operate said valve means between said open and closed positions, said control means including a hand-manipulable selector member movable to an operating position for engaging said control means.

12. The device of claim 11, wherein said selector means is movable between said operating position and a storage position disengaged from said control means.

13. The device of claim 12, wherein said cap includes a recess for receiving said selector member in said storage position and said selector member projects from said cap in said operating position.

14. The device of claim 11, wherein said control means includes a button member which is also hand-manipulable by a user of the device to operate said valve means and said selector member is movable between said operating position engaging said button member and a storage position disengagd from said button member.

15. The device of claim 14 including a sealing cap which closes the second end of the annular chamber.

16. The device of claim 10 including a frusto-conical shaped sealing ring mounted on the plunger which sealingly engages the first end of said annular chamber.

17. A beverage carbonating and dispensing device comprising:

(a) an insulated bottle having a mouth and an outer jacket to secure insulation about said bottle; a chamber formed between said insulation and said bottle with an entrance through the bottom of said jacket; means to open and close said entrance and a sealed cartridge pre-charged with a freezable gel formed to fit snugly within said chamber and in surface-to-surface contact with said bottle;

(b) a removable cap adapted to make a pressure-sealed engagement with said mouth;

(c) a hollow cylinder adapted to fit concentrically within said mouth and to extend downwardly into said bottle to form an air chamber beneath the mouth of said bottle;

(d) a check valve chamber located within said cap; a $CO_2$ capsule chamber formed adjacent to said check valve chamber and a charging valve chamber; said check valve chamber connected to said charging chamber;

(e) an imperforate tube positioned concentric with said hollow cylinder having an upper end extending into said cap chamber and sealed thereto, and a lower end adjacent the bottom of said bottle;

(f) means to house a $CO_2$ cartridge in one end of said $CO_2$ chamber, said imperforate tube also consisting of a combination charging and dispensing tube secured at one end to said charging valve chamber and extending into said bottle, the other end of said charging valve chamber open to the atmosphere;

(g) control valve means in said chamber between said other end of said cap chamber and said upper end of said tube; and (h) means to pierce said $CO_2$ cartridge to permit flow of $CO_2$ gas into said check valve chamber and through said tube to discharge into the bottom of said bottle; whereby upon removal of said cap liquid may be poured through the mouth of said bottle until said air space has been pressurized, whereby upon engagement of said cap to the mouth of said bottle, said $CO_2$ cartridge may be pierced to permit pressurized $CO_2$ gas to flow downwardly through said imperforate tube and to discharge into the bottom of said liquid filled bottle, and whereby said $CO_2$ gas percolates upwardly through said liquid to carbonate said liquid.

18. The device of claim 17, wherein the cross sections of said chamber and said cartridge are crescent-shaped to conform to the curvature of said bottle; and said means to open and to close said entrance comprises a rotatable disc having a crescent-shaped opening conforming to the crescent shape of said chamber and means to rotate said rotatable disc into and out of registry with said chamber entrance.

19. In a carbonated beverage making and dispensing mechanism having a beverage containing body with a necked-in top opening and a dispensing cap removably secureable to said necked-in opening and having a dispensing nozzle projecting therefrom, the improvement comprising: a vertical passageway in said cap open at the top; a manual actuating plunger received within said passageway and having an upper end substantially flush with the top surface of said cap, said passageway and said plunger being positioned immediately adjacent said dispensing nozzle; a lever having one end inward from said plunger and pivotally fixed to said cap and a free end remote from said cap, whereby said lever may be pivoted forwardly to overlap said plunger and to project over and in alignment with said dispensing nozzle and whereby downward pressure on the free end of said lever in said forward position will actuate said plunger, wherein said cap includes a U-shaped handle having front and back legs and a horizontal bridge therebetween, said handle being in longitudinal alignment with said dispensing nozzle; said vertical passageway extending upwardly in said front leg and said lever being recessed in a U-shaped trough in said horizontal bridge, and wherein said lever fills said U-shaped trough so that the top surface of said lever is in the same horizontal plane as the top edges of said U-shaped trough.

20. The device of claim 19, including gripping means on the free end of said lever to assist in the manual manipulation of said lever.

21. A beverage carbonating and dispensing device comprising:

(a) an insulated bottle having a mouth;

(b) a removable cap adapted to make a pressure-sealed engagement with said mouth, said cap having an upstanding U-shaped carrying handle;

(c) a hollow cylinder adapted to fit concentrically within said mouth and to extend downwardly into said bottle to form an air chamber beneath the mouth of said bottle;

(d) a check valve chamber located within said cap, a $CO_2$ capsule chamber formed adjacent to said check valve chamber and a charging valve chamber, said check valve chamber connected to said charging chamber;

(e) an imperforate tube positioned concentric with said hollow cylinder having an upper end extending into said cap chamber and sealed thereto, and a lower end adjacent the bottom of said bottle;

(f) means to house a $CO_2$ cartridge in one end of said $CO_2$ chamber, said imperforate tube also consisting of a combination charging and dispensing tube secured at one end to said charging valve chamber and extending into said bottle, the other end of said charging valve chamber open to the atmosphere;

(g) dispensing valve means in said chamber between said other end of said cap chamber and said upper end of said tube; said dispensing valve means projecting through a sealed opening in the top of the cap, means to resiliently urge said dispensing valve means upwardly into a closed position whereby said dispensing valve means may be shifted to an open position by manual pressure exerted downwardly on said dispensing valve means extension, and alternative means to shift said dispensing valve means into the open position comprising a central longitudinal top portion insert of said carrying handle embedded in a longitudinal trough in the top of said handle, the front end of said insert being pivoted to permit said insert to rotate forwardly to rest on the top of said extension and to extend therebeyond to provide mechanical leverage against the top of said extension; and (h) means to pierce said $CO_2$ cartridge to permit flow of $CO_2$ gas into said check valve chamber and through said tube to discharge into the bottom of said bottle, whereby upon removal of said cap liquid may be poured through the mouth of said bottle until said air space has been pressurized, whereby upon engagement of said cap to the mouth of said bottle, said $CO_2$ cartridge may be pierced to permit pressurized $CO_2$ gas to flow downwardly through said imperforate tube and to discharge into the bottom of said liquid filled bottle, and whereby said $CO_2$ gas percolates upwardly through said liquid to carbonate said liquid.

* * * * *